US006264446B1

(12) United States Patent
Rajendran et al.

(10) Patent No.: US 6,264,446 B1
(45) Date of Patent: Jul. 24, 2001

(54) HORIZONTAL SCROLL COMPRESSOR

(75) Inventors: Natarajan Rajendran, Huber Heights; Del H. Cabe, Sidney; Jason Prenger, Jackson Center; Dod Noffsinger, Anna, all of OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/496,937

(22) Filed: Feb. 2, 2000

(51) Int. Cl.[7] ..... F01C 1/02

(52) U.S. Cl. ..... 418/55.6; 418/55.4; 418/88; 184/6.16

(58) Field of Search ..... 418/55.6, 88, 55.4; 184/6.16

(56) References Cited

U.S. PATENT DOCUMENTS

| | | |
|---|---|---|
| 3,229,901 | 1/1966 | Parker . |
| 3,334,808 | 8/1967 | Parker et al. . |
| 3,448,918 | 6/1969 | Cawley . |
| 3,465,954 | 9/1969 | Ellis . |
| 3,545,891 | 12/1970 | Parker . |
| 3,584,980 | 6/1971 | Cawley et al. . |
| 3,586,456 | 6/1971 | Giacosa . |
| 4,449,895 | 5/1984 | Kurahayashi . |
| 4,456,437 | 6/1984 | Kurahayashi et al. . |
| 4,564,339 | 1/1986 | Nakamura et al. . |
| 4,568,253 | 2/1986 | Wood . |
| 5,221,191 | 6/1993 | Leyderman et al. . |
| 5,322,420 | 6/1994 | Yannascoli . |
| 5,385,453 | 1/1995 | Fogt et al. . |
| 5,391,066 | 2/1995 | Sawai et al. . |
| 5,445,507 | 8/1995 | Nakamura et al. . |
| 5,494,422 | 2/1996 | Ukai et al. . |
| 5,533,875 | 7/1996 | Crum et al. . |
| 5,553,465 | 9/1996 | Fukuda et al. . |
| 5,810,572 | 9/1998 | Yamamoto et al. . |
| 5,997,258 | 12/1999 | Sawyer, III et al. . |
| 6,039,551 | 3/2000 | Takeuchi et al. . |

*Primary Examiner*—Thomas Denion
*Assistant Examiner*—Theresa Trieu
(74) *Attorney, Agent, or Firm*—Harness, Dickey & Pierce, P.L.C.

(57) ABSTRACT

A vertical compressor is converted to a horizontal compressor by laying the vertical compressor on its side and locating it within the standard shell of a larger vertical compressor. The end caps and partition of the smaller compressor are removed while the end caps and the partition of the larger compressor are added. A lubricant pump pumps lubricant from the sump defined between the two shells to all areas of the compressor requiring lubrication.

21 Claims, 3 Drawing Sheets

HORIZONTAL SCROLL COMPRESSOR

FIELD OF THE INVENTION

The present invention relates to scroll machines. More particularly, the present invention relates to scroll compressors which are positioned horizontally and utilize an existing compressor shell to encase a second existing compressor shell within which the scroll compressor is located.

BACKGROUND AND SUMMARY OF THE INVENTION

Scroll type machines are becoming more and more popular for use as compressors in both refrigeration as well as air conditioning applications due primarily to their capability for extremely efficient operation. Generally, these machines incorporate a pair of intermeshed spiral wraps one of which is caused to orbit relative to the other so as to define one or more moving chambers which progressively decrease in size as they travel from an outer suction port toward a center discharge port. An electric motor is provided which operates to drive the orbiting scroll member via a suitable drive shaft affixed to the motor rotor. In a hermetic compressor, the bottom of the hermetic shell normally contains an oil sump for lubricating and cooling purposes.

Generally, the motor includes a stator which is secured to the shell of the compressor. The motor rotor rotates within the stator to impart rotation to a crankshaft which is normally press fit within the motor rotor. The crankshaft is rotationally supported by a pair of bearings which are supported by a main bearing housing and a secondary bearing housing. The crankshaft includes an eccentric crank pin which extends into a bore defined in a hub of the orbiting scroll. Disposed between the hub of the crank pin and the inner surface of the bore is a drive bushing which rides against a bearing that is press fit within the bore of the hub.

The design for scroll compressors position the central axis of the crankshaft in a vertical or horizontal position. One difference between the vertical and horizontal scroll compressor designs is the lubrication sump and the delivery systems which deliver the lubricant to the various components of the compressor which require lubrication. In a typical vertically positioned compressor, lubricant is stored in the lower portion of the shell with the lower end of the crankshaft being submerged within the sump. The crankshaft has a relatively large diameter centrally located bore which communicates with a radially outwardly inclined smaller diameter bore which extends to the top of the crankshaft. The larger diameter bore acts as a pump to pump the lubricating fluid up the crankshaft into the smaller diameter bore and ultimately to all of the various portions of the compressor which require lubrication.

When the compressor is positioned horizontally, it is not practical to immerse the end of the crankshaft within the lubricant since this would require filling over one-half of the shell with lubricant. The present invention provides the art with a horizontal compressor which includes a typical vertical compressor which has been positioned horizontally. The horizontally positioned vertical compressor is disposed within the shell of a larger vertical compressor to provide the necessary lubrication sump for the horizontal compressor.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 3 is a vertical cross-sectional view through the center of the scroll type refrigeration compressor shown in FIG. 1;

Detailed Description of the Preferred Embodiment

Figure 1:
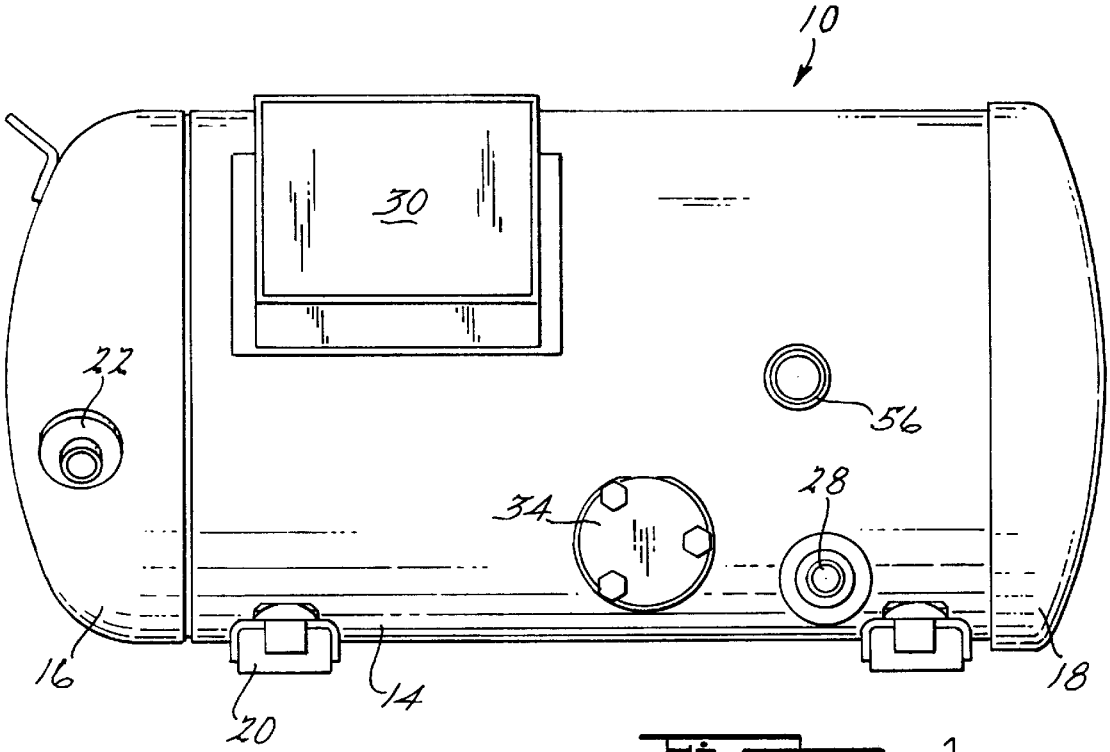
FIG. 1 is a side view of a horizontal scroll type refrigeration compressor in accordance with the present invention.
Figure 2:
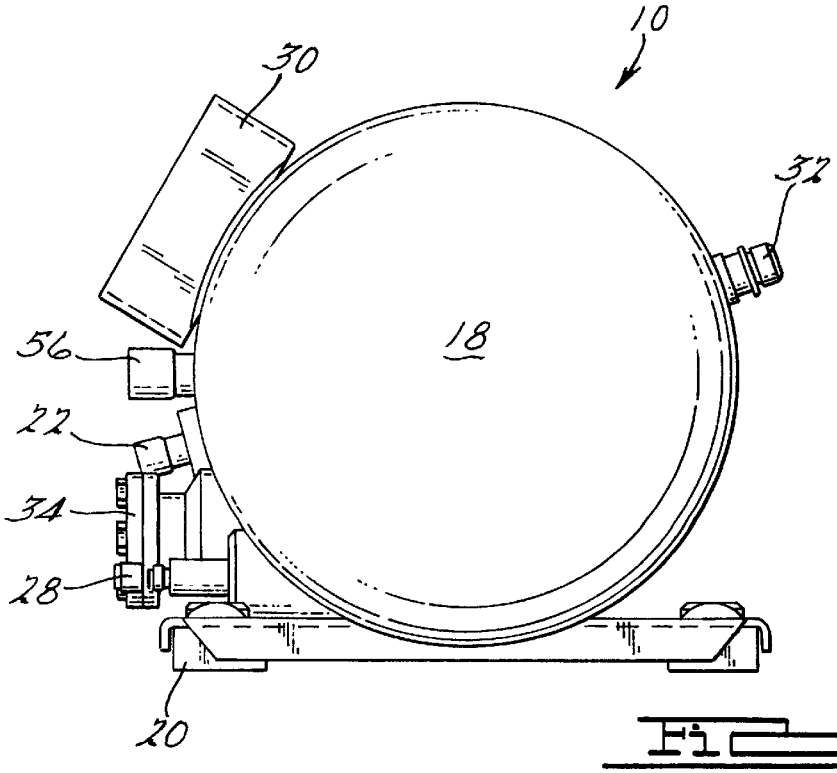
FIG. 2 is an end view of the horizontal scroll type refrigeration compressor shown in FIG. 1.
Figure 2:
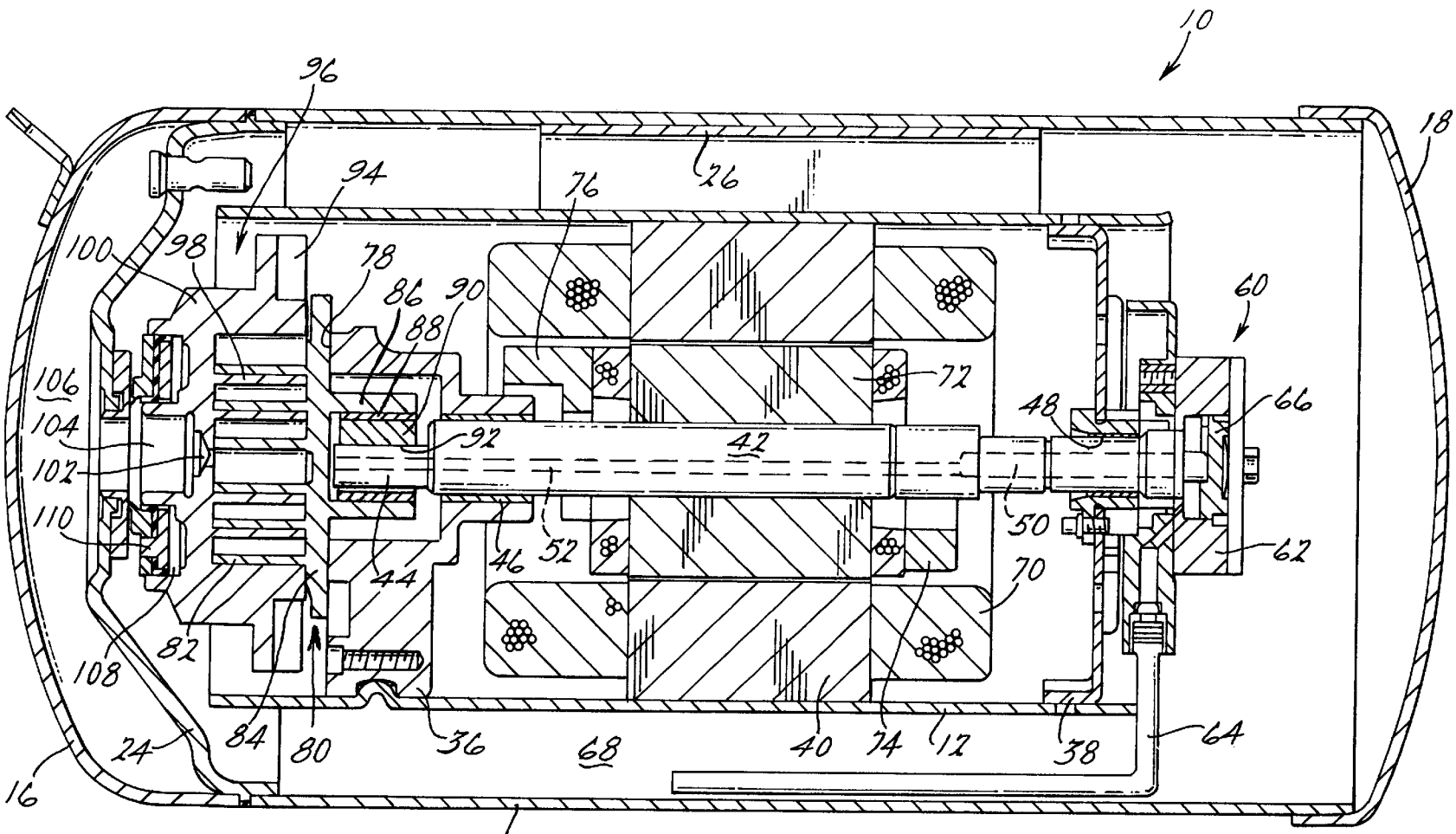
Figure 4:
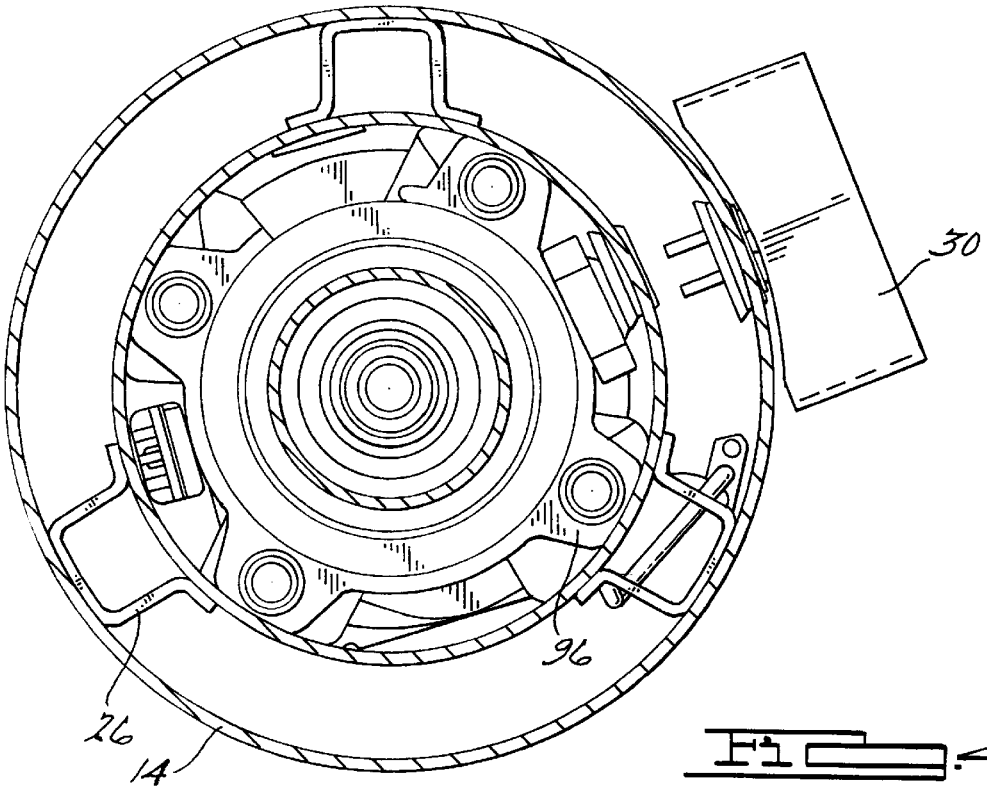
FIG. 4 is an end view of the scroll type refrigeration compressor shown in FIG. 1 with the cap and partition removed.
Figure 5:
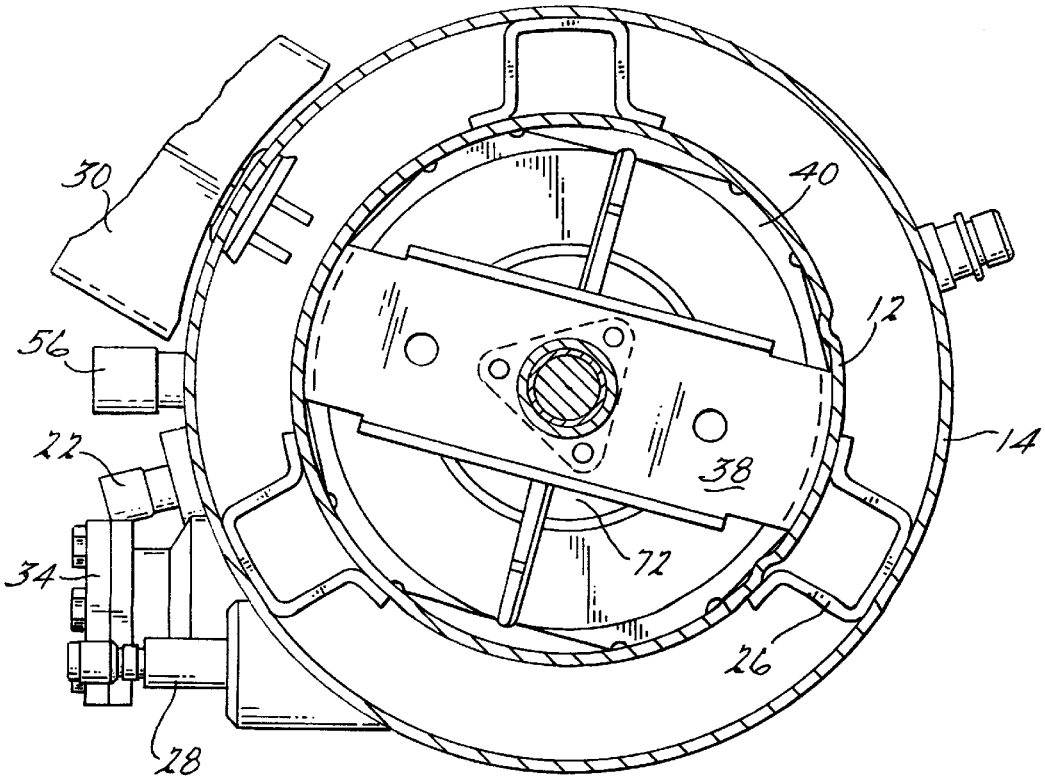
FIG. 5 is an end view of the scroll type refrigeration compressor at the end opposite to the one shown in FIG. 1 with the end cap and the oil pump removed.

Referring now to the drawings in which like reference numerals designate like or corresponding parts throughout the several views, there is shown in FIGS. 1–5 a horizontal-type refrigeration scroll compressor in accordance with the present invention which is designated generally by the reference numeral 10. Compressor 10 comprises an inner generally cylindrical shell 12 and an outer generally cylindrical hermetic shell 14. Inner generally cylindrical shell 12 is preferably a standard compressor shell from a currently existing vertical compressor. Likewise, outer generally cylindrical hermetic shell 14 is preferably a standard compressor shell from a currently existing vertical compressor which is larger than the compressor from shell 12. By utilizing two existing compressor shells, one large one small, the costs associated with producing horizontal compressor 10 can be reduced significantly.

Generally cylindrical hermetic outer shell 14 has welded at one end thereof an end cap 16 and at the opposite end an end cap 18. A plurality of feet 20 are secured to shell 14 to facilitate this positioning of compressor 10 within a refrigeration system. Cap 16 is provided with a refrigerant discharge fitting 22 which may have the usual discharge valve therein. Other major elements affixed to shell 14 include a transversely extending partition 24 which is welded about its periphery at the same point that end cap 16 is welded to shell 14, a suction fitting 56, an oil drain fitting 28, a terminal block 30, a liquid injection fitting 32 and a sight glass 34. Inner shell 12 is disposed within outer shell 14 and it is centrally positioned within outer shell 14 by a plurality of spacers 26.

Major elements which are affixed to shell 12 include a main bearing housing 36 which is suitably secured to shell 12 by a plurality of radially outwardly extending legs and a secondary bearing housing 38 also having a plurality of radially outwardly extending legs each of which is also suitably secured to shell 12. A motor stator 40 which is generally square or hexagonal in cross-section but with the corners rounded off is press fitted into shell 12. The flats between the rounded corners on stator 40 provide passageways between stator 40 and shell 12, which facilitate the flow of lubricant and refrigerant gas within shell 12.

A drive shaft or crankshaft 42 having an eccentric crank pin 44 at one end thereof is rotatably journaled in a bearing 46 in main bearing housing 36 and a second bearing 48 in secondary bearing housing 38. Crankshaft 42 has at the opposite end a relatively large diameter concentric bore 50 which communicates with a radially outwardly inclined smaller diameter bore 52 extending through crankshaft 42. Secured to the outer side of secondary bearing housing 38 is a lubricant pumping system 60 which is powered by crankshaft 42. Pumping system 60 includes an inlet housing assembly 62, an inlet tube 64 and a lubricant pump 66 driven by crankshaft 42. Lubricant pump 66 is secured to inlet housing assembly 62 which is in turn secured to secondary bearing housing 38. Inlet tube 64 extends from inlet housing assembly 62 to a power position between shells 12 and 14. The lower position between shells 12 and 14 define a sump 68 within which lubricant is accumulated. Pump 66 draws lubricant from sump 68 through tube 64 and housing assembly 62 and pumps this lubricant into bore 50 and into bore 52 and ultimately to all of the various portions of compressor 10 which require lubrication.

Crankshaft 42 is rotatively driven by an electric motor including stator 40, windings 70 passing therethrough and a rotor 72 press fitted on crankshaft 42 and having first and second counterweights 74 and 76, respectively.

The outer surface of main bearing housing 36 is provided with a flat thrust bearing surface 78 against which is disposed an orbiting scroll member 80 having the usual spiral vane or wrap 82 extending outward from an end plate 84. Projecting outwardly from the opposite surface of end plate 84 of orbiting scroll member 80 is a cylindrical hub 86 having a journal bearing 88 therein and in which is rotatively disposed a drive bushing 90 having an inner bore 92 in which crank pin 44 is drivingly disposed. Crank pin 44 has a flat on one surface which drivingly engages a flat surface (not shown) formed in a portion of bore 92 to provide a radially compliant driving arrangement, such as shown in assignee's U.S. Pat. No. 4,877,382, the disclosure of which is hereby incorporated herein by reference. An Oldham coupling 94 is also provided positioned between orbiting scroll member 80 and bearing housing 36 and keyed to orbiting scroll member 80 and a non-orbiting scroll member 96 to prevent rotational movement of orbiting scroll member 80. Oldham coupling 94 is preferably of the type disclosed in assignee's co-pending U.S. Pat. No. 5,320,506, the disclosure of which is hereby incorporated herein by reference.

Non-orbiting scroll member 96 is also provided having a wrap 98 extending outwardly from an end plate 100 which is positioned in meshing engagement with wrap 82 of orbiting scroll member 80. Non-orbiting scroll member 96 has a centrally disposed discharge passage 102 which communicates with an upwardly open recess 104 which in turn is in fluid communication with a discharge muffler chamber 106 defined by cap 16 and partition 24. An annular recess 108 is also formed in non-orbiting scroll member 96 within which is disposed a seal assembly 110. Recesses 104 and 108 and seal assembly 110 cooperate to define axial pressure biasing chambers which receive pressurized fluid being compressed by wraps 82 and 98 so as to exert an axial biasing force on non-orbiting scroll member 96 to thereby urge the tips of respective wraps 82, 98 into sealing engagement with the opposed end plate surfaces of end plates 100 and 84, respectively. Seal assembly 110 is preferably of the type described in greater detail in U.S. Pat. No. 5,156,539, the disclosure of which is hereby incorporated herein by reference. Non-orbiting scroll member 96 is designed to be mounted to bearing housing 36 in a suitable manner such as disclosed in the aforementioned U.S. Pat. No. 4,877,382 or U.S. Pat. No. 5,102,316, the disclosure of which is hereby incorporated herein by reference.

Thus, horizontal compressor 10 of the present invention provides the art with an effective cost reducing method of converting a typical vertically oriented compressor into a horizontal compressor. The utilization of two shells from existing vertical compressors enables a low cost conversion to the horizontal system. The existing smaller shell with its compressor mounted within it is located within the shell of a large compressor. The two shells form a lubricant sump from which lubricant is pumped by a pumping system powered by the rotating crankshaft.

While the above detailed description describes the preferred embodiment of the present invention, it should be understood that the present invention is susceptible to modification, variation and alteration without deviating from the scope and fair meaning of the subjoined claims.

What is claimed is:

1. A horizontal scroll machine comprising:

a first shell;

a first scroll member disposed within said first shell, said first scroll member having a base plate and a first spiral wrap extending from said first base plate;

a second scroll member disposed within said first shell, said second scroll member having a second base plate and a second spiral wrap extending from said second base plate, said second spiral wrap being intermeshed with said first spiral wrap;

a drive member for causing said scroll members to orbit relative to one another whereby said spiral wraps create pockets of progressively changing volume between a suction pressure zone and a discharge pressure zone;

a second shell;

a first end cap attached to said second shell;

a second end cap attached to said second shell, said end caps and said second shell defining an internal chamber, said first shell being disposed entirely within said chamber spaced from said first and second end caps, said second shell defining a lubricant sump; and a partition secured to said second shell, said partition separating said internal chamber into said suction pressure zone and said discharge pressure zone.

2. The scroll machine according to claim 1, further comprising a lubricant pump driven by said drive member, said lubricant pump being operable to pump lubricant from said sump.

3. The scroll machine according to claim 1, further comprising at least one spacer disposed between said first and second shells.

4. The scroll machine according to claim 1, wherein said first and second shells are cylindrical, said first and second shells being disposed co-axially.

5. The scroll machine according to claim 1, wherein said first and second shells each define a horizontal axis, said axes being parallel.

6. The scroll machine according to claim 5, wherein said axes are co-linear.

7. The scroll machine according to claim 1, further comprising a main bearing housing secured to said first shell, said main bearing housing rotatably supporting said drive member.

8. The scroll machine according to claim 7, further comprising a secondary bearing housing secured to said first shell, said secondary bearing housing rotatably supporting said drive member.

9. The scroll machine according to claim 8, further comprising a lubricant pump secured to said secondary bearing housing, said lubricant pump being operable to pump lubricant from said sump.

10. The scroll machine according to claim 9, wherein said lubricant pump is driven by said drive member.

11. The scroll machine according to claim 1, further comprising a suction inlet extending through said second shell.

12. The scroll machine according to claim 11, further comprising a discharge outlet extending through said second shell, said partition being disposed between said discharge outlet and said suction inlet.

13. The scroll machine according to claim 1, further comprising a discharge outlet extending through said second shell.

14. The scroll machine according to claim 1, further comprising a floating seal disposed between said partition and one of said scroll members.

15. A scroll machine comprising:

a first shell defining a chamber;

a first end cap attached to said first shell;

a second end cap attached to said first shell;

a partition dividing said chamber into a suction pressure zone and a discharge pressure zone;

a second shell disposed within said suction pressure zone spaced from said first and second end caps;

a first scroll member disposed within said second shell, said first scroll member having a base plate and a first spiral wrap extending from said first base plate;

a second scroll member disposed within said second shell, said second scroll member having a second base plate and a second spiral wrap extending from said second base plate, said second spiral wrap being intermeshed with said first spiral wrap; and a drive member disposed within said second shell for causing said scroll members to orbit relative to one anther whereby said spiral wraps create pockets of progressively changing volume between said suction pressure zone and said discharge pressure zone.

16. The scroll machine according to claim 15, wherein a lubricant sump is defined between said first and second shells and said scroll machine further comprises a lubricant pump operable to pump lubricant from said sump.

17. The scroll machine according to claim 16, wherein said lubricant pump is driven by said drive member.

18. The scroll machine according to claim 15, further comprising at least one spacer disposed between said first and second shells.

19. The scroll machine according to claim 15, wherein said first and second shells are cylindrical, said first and second shells being disposed co-axially.

20. The scroll machine according to claim 15, wherein said first and second shells each define a horizontal axis, said axes being parallel.

21. The scroll machine according to claim 20, wherein said axes are co-linear.

* * * * *

UNITED STATES PATENT AND TRADEMARK OFFICE

CERTIFICATE OF CORRECTION

PATENT NO. : 6,264,446 B1
DATED : July 24, 2001
INVENTOR(S) : Natarajan Rajendran et al.

It is certified that error appears in the above-identified patent and that said Letters Patent is hereby corrected as shown below:

Title page,

Under References Cited, U.S. PATENT DOCUMENTS, insert the following:

-- 5,358,392 10/1994 Ukai 418/94 --.
-- 5,522,715 6/1996 Watanabe et al. 418/55.1 --.
-- 5,156,539 10/1992 Anderson et al. 418/55.5 --.
-- 5,667,371 9/1997 Prenger et al. 418/55.1 --.
-- 5,921,761 7/1999 Eckels 418/55.1 --.

Under References Cited, FOREIGN PATENT DOCUMENTS, insert the following:

-- 02-064283 3/1990 (JP) 417/902 --.
-- 03-206388 9/1991 (JP) 418/55.6 --.
-- 04-298693 10/1992 (JP) 418/55.6 --.
-- 06-002673 1/1994 (JP) 418/55.6 --.
-- 06-010851 1/1994 (JP) 418/55.6 --.
-- 09-105392 4/1997 (JP) 418/55.6 --.
-- 10-141258 5/1998 (JP) 418/55.6 --.
-- 10-318166 12/1998 (JP) 418/55.6 --.

Column 6,

Line 3, "anther" should be -- another --.

Signed and Sealed this

Sixteenth Day of April, 2002

*Attest:*

*Attesting Officer*

JAMES E. ROGAN
*Director of the United States Patent and Trademark Office*